US011229241B2

(12) United States Patent
Adams

(10) Patent No.: US 11,229,241 B2
(45) Date of Patent: Jan. 25, 2022

(54) LOWER GARMENT GUSSET REINFORCEMENT SYSTEM FOR PREVENTING FRONTAL RISE

(71) Applicant: Nika Maria Adams, San Diego, CA (US)

(72) Inventor: Nika Maria Adams, San Diego, CA (US)

( * ) Notice: Subject to any disclaimer, the term of this patent is extended or adjusted under 35 U.S.C. 154(b) by 0 days.

(21) Appl. No.: 16/260,523

(22) Filed: Jan. 29, 2019

(65) Prior Publication Data

US 2020/0237021 A1 Jul. 30, 2020

(51) Int. Cl.
*A41B 9/04* (2006.01)
*A41B 9/00* (2006.01)

(52) U.S. Cl.
CPC ..... *A41B 9/04* (2013.01); *A41B 9/004* (2013.01)

(58) Field of Classification Search
CPC .. A41B 9/04; A41B 9/004; A41B 9/00; A41B 9/002; A41B 2400/38; A41D 7/00; A41D 7/005; A41D 13/0525; A41D 1/088; A41D 27/02; A63B 71/1216; A61F 13/4702
USPC ..... 2/400, 401, 406, 407, 408, 409
See application file for complete search history.

(56) References Cited

U.S. PATENT DOCUMENTS 3,333,589 A 8/1967 Cohen et al.
4,229,835 A 10/1980 Shaw
4,400,832 A 8/1983 Kinder
5,023,957 A 6/1991 Harvey
5,081,716 A 1/1992 Lehenbauer et al.
5,359,732 A 11/1994 Waldman et al.
5,533,212 A 7/1996 Moretz et al.
6,393,621 B1 5/2002 Redwine et al.
6,610,901 B2 8/2003 McMahon-Ayerst et al.
7,260,961 B1 8/2007 Kennedy
7,721,356 B2 * 5/2010 Utaka ..... A41B 9/004 2/406
8,499,364 B2 * 8/2013 Dye ..... A41B 9/004 2/406
9,018,436 B2 * 4/2015 Kikuchi ..... A61F 13/496 604/380
9,060,863 B2 * 6/2015 Zaltsberg ..... A61F 5/30
2004/0098784 A1 5/2004 Desai
2007/0199134 A1 8/2007 Duckman et al.
2013/0327340 A1 * 12/2013 Hardig ..... A41B 9/12 128/846

(Continued)

*Primary Examiner* — F Griffin Hall
(74) *Attorney, Agent, or Firm* — Morrison & Foerster LLP

(57) ABSTRACT

A lower garment gusset portion reinforcement system is provided. The system embodies a gusset insert for operatively reinforcing the gusset portion. The gusset insert may be made of a breathable, stretchable material. The gusset insert may have an upper portion and a lower portion. The shape of the upper portion is defined by lateral edges that arcuately taper inwardly and backwardly toward the lower portion, so that the upper portion has a sloped thickness, while the lateral edges of the lower portion continuously arcuately tapers inwardly but provide a uniform thickness. The sloped thickness and tapering lateral width enables reinforcement of the associated gusset portion for preventing folding along a longitudinal axis, while still enabling the gusset insert to bend in a direction orthogonal to the longitudinal axis about the thickness of the gusset insert so that it conforms to the wearer's lower torso.

8 Claims, 3 Drawing Sheets

(56) References Cited

U.S. PATENT DOCUMENTS

| | | | |
|---|---|---|---|
| 2014/0041097 | A1 | 2/2014 | Toratani |
| 2016/0029703 | A1 | 2/2016 | Han |
| 2016/0165959 | A1 | 6/2016 | Hayes |
| 2017/0086509 | A1 | 3/2017 | Etienne |

* cited by examiner

LOWER GARMENT GUSSET REINFORCEMENT SYSTEM FOR PREVENTING FRONTAL RISE

BACKGROUND OF THE INVENTION

The present invention relates to female undergarment and, more particularly, to a lower garment gusset reinforcement system for preventing frontal rise.

Every day women are inconvenienced with hiding their "frontal rise" (colloquially known as, "camel toe") which is typically caused by the folding of the gusset portion within their underwear or pants.

Current solutions to this problem are insufficient. For example, some people use standalone inserts. Such inserts are very uncomfortable as they can separate from the surface of the underwear they are inserted into, and so uncomfortably move around, rather than move with the wearer's body. Moreover, such inserts are typically one-size-fits-all, and so simply aren't efficiently designed for the woman on the go. Furthermore, such inserts are made of non-breathable material, such as silicone, which is not safe for a woman's vaginal biochemistry.

As can be seen, there is a need for a lower garment gusset reinforcement system embodying a sewn-in breathable neoprene gusset insert dimensioned and adapted to conform to the wearer so that the gusset portion of their lower undergarment is reinforced against frontal rise. The neoprene gusset insert may be strategically sewn into the gusset portion by way of a fabric liner, enabling the neoprene gusset insert to stay in place, while providing a "barely there" feel which results in an ultra-comfort feel. The breathability of the neoprene insert is safe for vaginal biochemistry, while the stretchable nature of the neoprene insert allows for movement with a user's body by conforming thereto, essentially achieving a "to scale" effect.

SUMMARY OF THE INVENTION

In one aspect of the present invention, lower garment gusset portion reinforcement system, providing the following components: a gusset insert including the following: an upper portion defined by lateral edges that arcuately taper inwardly and backwardly toward the lower portion, so that the upper portion has a sloped thickness; a lower portion defined by lateral edges that arcuately taper inwardly but provide a uniform thickness; and the gusset insert made from a material that is both breathable and stretchable, wherein the upper portion is dimensioned and adapted to be located adjacent to the labia of a human wearer when the lower garment is worn; and an inner liner joined to an inner surface of the lower garment gusset portion so as to defined a pocket therebetween housing the gusset insert, whereby the gusset insert prevents the gusset portion from folding along its longitudinal axis yet the gusset insert is bendable about a latitudinal axis orthogonal to the longitudinal axis for conforming to the human wearer, wherein the lower portion has a uniform thickness, and wherein the upper portion has a sloped thickness never thicker than the uniform thickness.

These and other features, aspects and advantages of the present invention will become better understood with reference to the following drawings, description and claims.

DETAILED DESCRIPTION OF THE INVENTION

Figure 1:
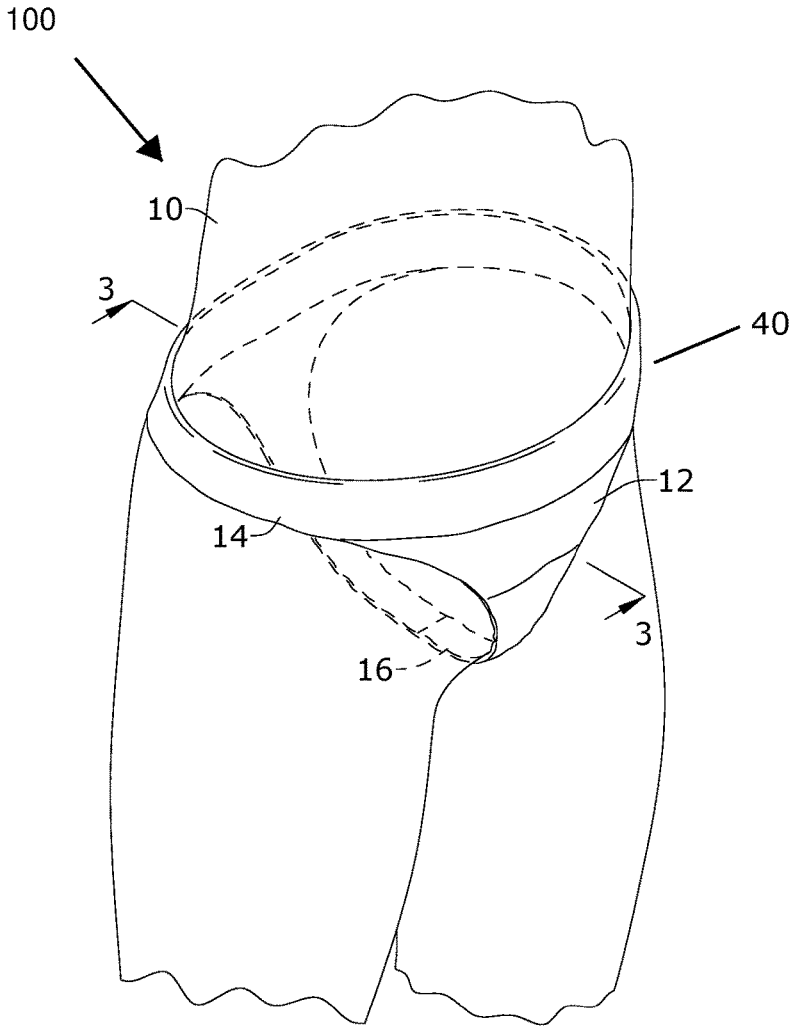
FIG. 1 is a perspective view of an exemplary embodiment of the present invention, shown in use.
Figure 2:
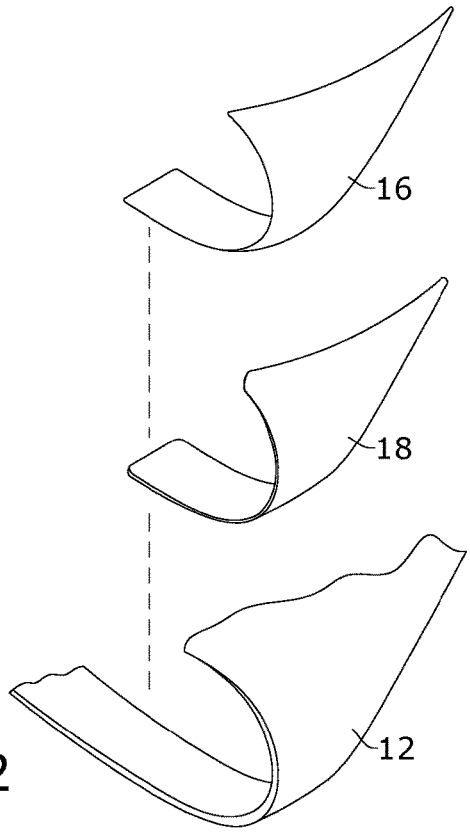
FIG. 2 is an exploded view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a gusset reinforcement system providing a gusset insert for operatively reinforcing a gusset portion of a lower garment. The gusset insert may be made of a breathable, stretchable material. The gusset insert may have an upper portion and a lower portion. The shape of the upper portion is defined by lateral edges that arcuately taper inwardly and backwardly toward the lower portion, so that the upper portion has a sloped thickness, while the lateral edges of the lower portion continuously arcuately tapers inwardly but provide a uniform thickness. The sloped thickness and tapering lateral width enables reinforcement of the associated gusset portion for preventing folding along a longitudinal axis, while still enabling the gusset insert to bend in a direction orthogonal to the longitudinal axis about the thickness of the gusset insert so that it conforms to the wearer's lower torso.

Referring to FIGS. 1 through 6, the present invention may include a gusset reinforcement system 100 providing a gusset insert 18 for an undergarment 40 dimensioned and adapted to be worn around the lower torso of a female human wearer 10. The undergarment 40 may include a waistband 14 and a gusset portion 12. The gusset portion 12 may be dimensioned and adapted to be located adjacent to and extend between the anus and to just above the labia majora of the wearer 10 when the undergarment 40 is worn. The undergarment 40 may be made from durable, flexible material, such as 82% nylon/polyamid and 18% elastane, or the like.

The gusset insert 18 may have the same proportional shape of the gusset portion, but slightly less than coextensive with the gusset portion 12. In certain embodiments, the periphery of the gusset insert 18 is approximately ⅛" less narrow than the periphery of the gusset portion 12, allowing for seams and stitching required as described herein. As a result, the gusset insert 18 may also be dimensioned and adapted to be located adjacent to and extend between the anus and to just above the labia majora of the wearer 10 when the undergarment 40 is worn. In doing so the gusset insert 18 may extend from an upper end 30 located just above the labia majora, and a lower end 52 located near the anus when the undergarment 40 is worn. The gusset insert 18 may be made of a breathable, stretchable material, such as neoprene, Mono 30D, Poly 130D, Spandex (OP) 78D, and the like.

Figure 5:
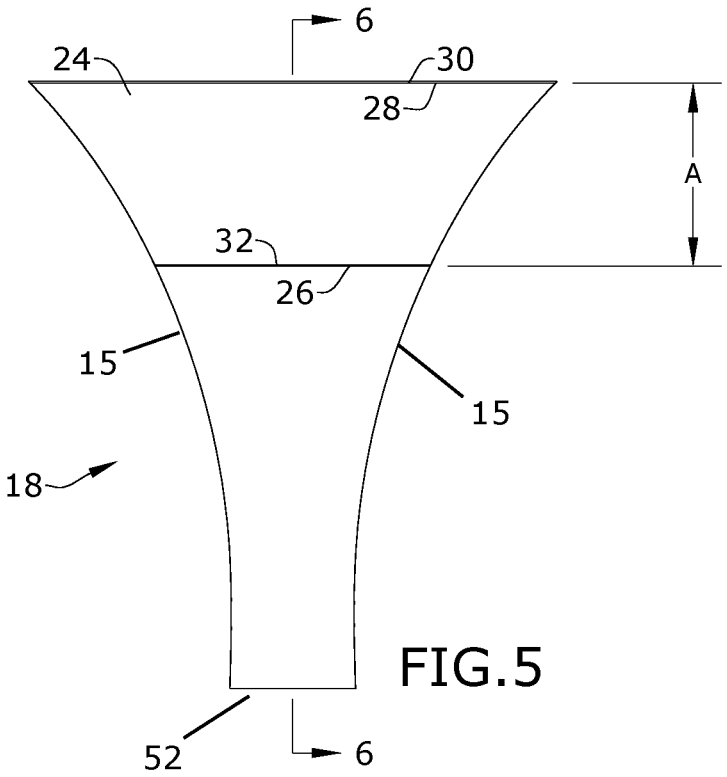
FIG. 5 is a front view of an exemplary embodiment of the present invention, illustrating the lateral edge tapering of the upper portion.
Figure 6:
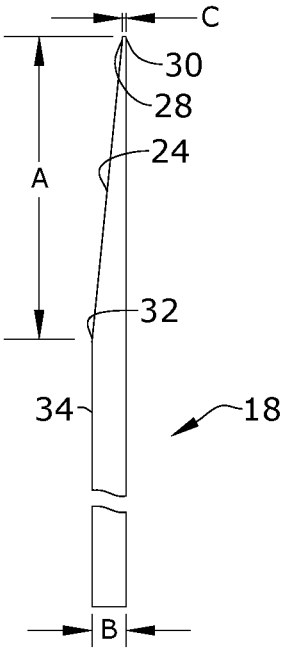
FIG. 6 is a section view of an exemplary embodiment of the present invention, taken along line 6-6 of FIG. 5.

Referring to FIG. 5, the gusset insert 18 may have an upper portion 24 and a lower portion 34, wherein the upper portions 24 extends from the upper end 30 to a transition point 32, and wherein the lower portion 34 extends from the transition point 32 to the lower end 52. The lateral edges 15 of the upper portion 24 arcuately tapers inwardly at an angle of convergence and backwardly at a slope toward the transition point 32. The lateral edges 15 of the lower portion 34 arcuately tapers inwardly at the angle of convergence, but does not a slope toward the lower end 52. As a result, the lower portion 34 has a generally uniform maximum lower thickness 26/B, while the upper portion 24 tapers from said lower thickness B to a minimum upper thickness 28/C, wherein such linear tapering is defined by the slope defined by A over (B-C).

For some embodiments, the thickness of 'C' is 1/32th of an inch, and the thickness of 'B' is 1/8$^{th}$ of an inch. The upper portion 34 may extend for a length ranging between ¾ and 1 ¼ inches, depending the size of the overall gusset reinforcement system 100 (extra-small size being the ¾" and the extra-large size being 1 ¼"). The upper portion 34 may extend for a length ranging between 3 ⅜ and 4 5/16 inches, depending the size of the overall gusset reinforcement system 100 (extra-small size being the 3 ⅜" and the extra-large size being 4 5/16").

An inner liner 16 may be joined along the inner surface of the gusset portion 12 so as to define a pocket 80 for housing the gusset insert 18. The inner liner 16 may be joined to the gusset portion 12 by way of stitching 20 and 22 or other joining methods. In certain embodiments, the pocket 80 may have a peripheral opening for removably and interchangeably slide the gusset insert therethrough. The inner liner 16 may be made from durable, flexible material, such as cotton jersey: 95% cotton and 5% spandex.

In one embodiment, a method of manufacturing the present invention includes the following. Once gusset insert 18 and inner liner 16 are cut, the inner liner 16 may be joined to the gusset portion 12 may be sewn together with a thread overlock joining crotch seam. This is then followed by any leg opening finish which may include ¼" foldback and a ⅛" wide baby double needle cover-stitch. The gusset portion 12 may now be secured to the waistband 14, which leaves the remainder of a desired lower garment to be assembled, for example for making pants.

Figure 3:
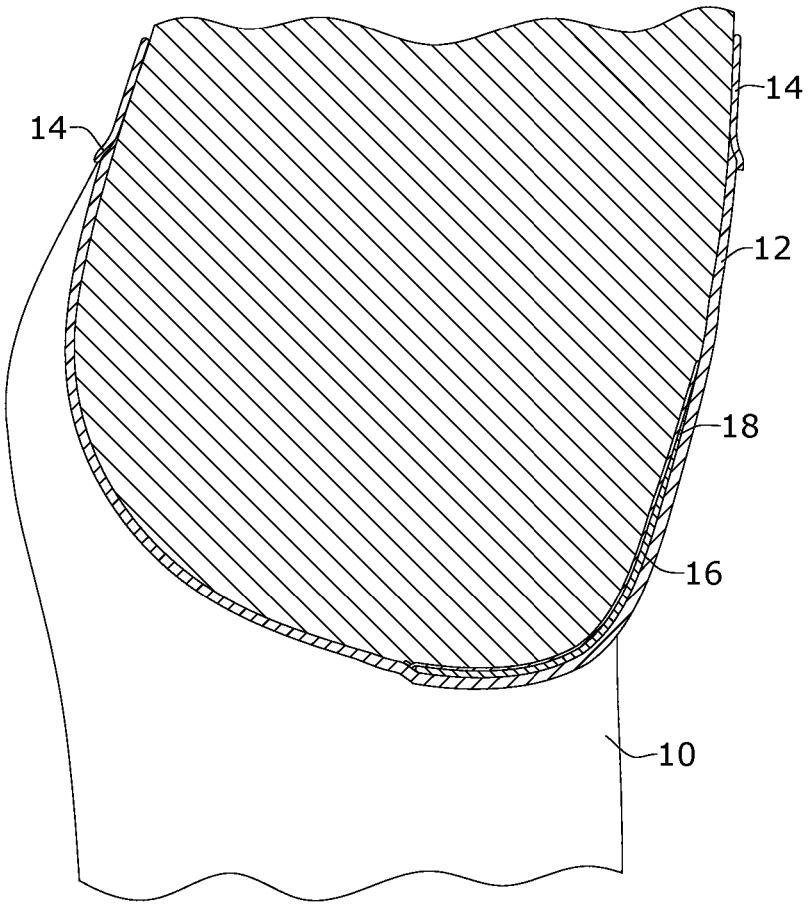
FIG. 3 is a section view of an exemplary embodiment of the present invention, taken along line 3-3 of FIG. 1.
Figure 4:
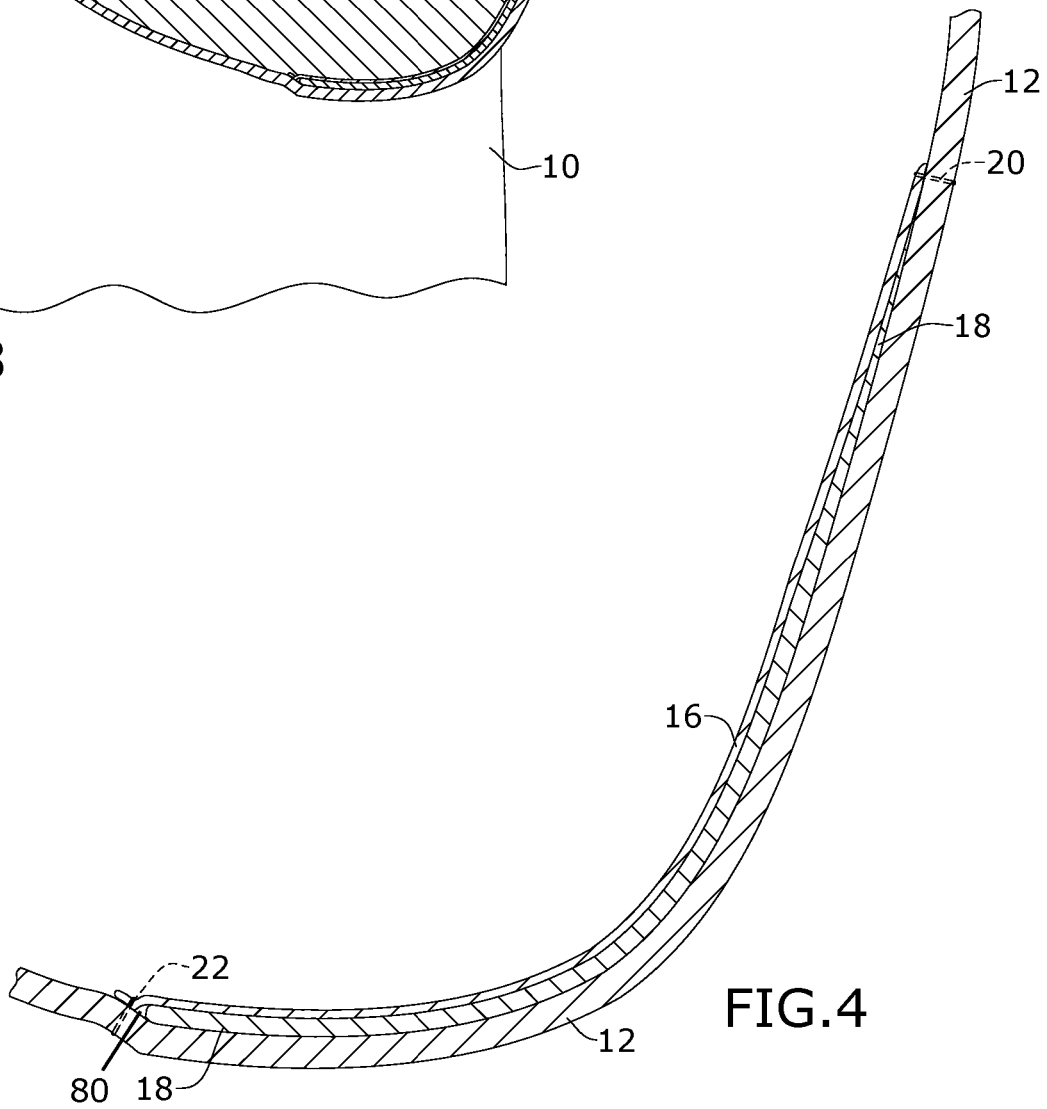
FIG. 4 is a detail section view of an exemplary embodiment of the present invention.

A method of using the present invention may include the following. The gusset reinforcement system 100 disclosed above may be provided. A wearer 10 dons the undergarment 40 so that the lower portion 34 of the gusset insert 18 is located adjacent to the anus of the wearer 10 and the upper portion 24 is located adjacent to the labia majora of the wearer 10 when the undergarment 40 is worn. The gusset insert 18, being made from an elastic, stretchable material, would conform to the shape of the user's lower torso, as illustrated in FIG. 3. The gusset reinforcement system 100 can be used and be operatively associated with the gusset portions of underwear, thongs, leggings, pants, swimsuits, bodysuits, and the like for reinforcing said gusset portions and preventing frontal tip.

It should be understood, of course, that the foregoing relates to exemplary embodiments of the invention and that modifications may be made without departing from the spirit and scope of the invention as set forth in the following claims.

What is claimed is:

1. A lower garment gusset portion reinforcement system, comprising:

a gusset insert comprising:

an upper portion defined by lateral edges that arcuately taper inwardly toward a lower portion, wherein the upper portion has a sloped thickness, the lower portion defined by lateral edges that arcuately taper inwardly, and wherein the lower portion has a uniform thickness, and wherein the gusset insert is made from a material that is both breathable and stretchable, wherein the gusset insert has a uniform thickness across a latitudinal axis orthogonal to a longitudinal axis, and wherein the upper portion is dimensioned and adapted to be located adjacent to the labia of a human wearer when the lower garment is worn; and an inner liner joined to an inner surface of the lower garment gusset portion so as to define a pocket therebetween housing the gusset insert, whereby the gusset insert prevents the gusset portion from folding along its longitudinal axis yet the gusset insert is bendable about the latitudinal axis for conforming to the human wearer.

2. The lower garment gusset portion reinforcement system of claim 1, wherein the breathable and stretchable material is neoprene.

3. The lower garment gusset portion reinforcement system of claim 1, wherein the upper portion has a sloped thickness never thicker than the uniform thickness.

4. The lower garment gusset portion reinforcement system of claim 1, wherein the gusset insert has a shape coextensive with a shape of the gusset portion and wherein a width of the gusset insert is ⅛ of an inch less than a width of the gusset portion.

5. A lower garment gusset portion reinforcement system, comprising:

a gusset insert comprising:

an upper portion defined by lateral edges that arcuately taper inwardly toward a lower portion, wherein the upper portion has a sloped thickness never thicker than the lower portion, wherein the lower portion is defined by lateral edges that arcuately taper inwardly, wherein the lower portion has a uniform thickness, wherein the gusset insert is made from a material that is both breathable and stretchable, and wherein the upper portion is dimensioned and adapted to be located adjacent to the labia of a human wearer when the lower garment is worn; and an inner liner joined to an inner surface of the lower garment gusset portion so as to define a pocket therebetween housing the gusset insert, whereby the gusset insert prevents the gusset portion from folding along its longitudinal axis yet the gusset insert is bendable about a latitudinal axis orthogonal to the longitudinal axis for conforming to the human wearer.

6. The lower garment gusset portion reinforcement system of claim 5, wherein the breathable and stretchable material is neoprene.

7. The lower garment gusset portion reinforcement system of claim 5, wherein the gusset insert has a uniform thickness across a lateral cross section.

8. The lower garment gusset portion reinforcement system of claim 5, wherein the gusset insert has a shape coextensive with a shape of the gusset portion and wherein a width of the gusset insert is ⅛ of an inch less than a width of the gusset portion.

* * * * *